United States Patent [19]

Lenaerts et al.

[11] Patent Number: 4,775,326

[45] Date of Patent: Oct. 4, 1988

[54] CONTACT PIN

[75] Inventors: Jean P. E. A. Lenaerts, Mechelen; Danny L. C. Morlion, Gent, both of Belgium

[73] Assignee: Burndy Electra N.V., Mechelen, Belgium

[21] Appl. No.: 157,096

[22] Filed: Feb. 9, 1988

Related U.S. Application Data

[63] Continuation of Ser. No. 810,992, Dec. 19, 1985, abandoned.

[30] Foreign Application Priority Data

Dec. 6, 1985 [EP] European Pat. Off. ..... 85202028.8

[51] Int. Cl.[4] ..... H01R 13/428

[52] U.S. Cl. ..... 439/82; 439/751

[58] Field of Search ..... 439/82, 751, 825–827, 439/873

[56] References Cited

U.S. PATENT DOCUMENTS

| | | | |
|---|---|---|---|
| 2,183,067 | 12/1939 | Gardner | 339/195 R |
| 2,542,609 | 2/1951 | Wyglendowski | 339/196 A |
| 3,783,433 | 1/1974 | Kurtz et al. | 339/17 C |
| 3,997,237 | 12/1976 | White | 339/221 R |
| 4,066,326 | 1/1978 | Lovendusky | 339/221 M |
| 4,186,982 | 2/1980 | Cobaugh et al. | 339/17 C |
| 4,230,384 | 10/1980 | Anhalt | 339/252 P |
| 4,443,053 | 4/1984 | Astbury | 339/221 R |

FOREIGN PATENT DOCUMENTS

| | | |
|---|---|---|
| 105044 | 4/1984 | European Pat. Off. . |
| 1132614 | 7/1962 | Fed. Rep. of Germany . |
| 2545505 | 4/1976 | Fed. Rep. of Germany . |
| 3006437 | 9/1980 | Fed. Rep. of Germany . |
| 1268834 | 6/1961 | France . |
| 2287827 | 5/1976 | France . |
| 891418 | 3/1962 | United Kingdom . |
| 1087422 | 10/1967 | United Kingdom . |

*Primary Examiner*—Gil Weidenfeld
*Assistant Examiner*—Gary F. Paumen
*Attorney, Agent, or Firm*—Ernest Fanwick

[57] ABSTRACT

A contact pin for a printed circuit board comprises a mounting portion for mounting the contact pin in a hole in the printed circuit board. The mounting portion comprises three legs extending in the longitudinal direction of the contact pin, at least the outer legs joining a solid contact pin portion at both ends. As seen in cross section, the center leg is bent radially outwardly and lies with its inwardly directed part between the outer legs. Both outer legs are mainly twisted to a position in which these outer legs extend obliquely outwardly from the center leg, as seen in cross section. The center leg is displaced radially outwardly with respect to the longitudinal axis of the contact pin a constant distance substantially along its whole length. As seen in cross section, the center of the circle touching the outer side of the three legs, lies at a distance from the longitudinal axis of the contact pin in a direction radially opposite from the center leg.

5 Claims, 2 Drawing Sheets

CONTACT PIN

This application is a continuation, of application Ser. No. 810,992, filed Dec. 19, 1985, now abandoned.

BACKGROUND OF THE INVENTION

The invention relates to a contact pin for a printed circuit board, comprising a mounting portion for mounting the contact pin in a hole in the printed circuit board, said mounting portion having a first outer leg, a centre leg and a second outer leg, each leg extending in the longitudinal direction of the contact pin, at least the outer legs joining a solid contact pin portion at both ends, the centre leg lying with its inwardly directed part between the outer legs.

Such a contact pin is known from U.S. Pat. No. 4,066,326. At this known contact pin both outer legs are bent radially outwardly in the opposite direction from the centre leg, wherein seen in cross section, the centre of the circle touching the outer side of each of the legs lies on the longitudinal axis of the contact pin. When the contact pin is inserted into a hole, the legs move towards each other in a direction parallel with the symmetry plane of the contact pin. Because the legs are at least partially moved back to their original position, forces extending substantially in the longitudinal direction of the contact pin are exerted on the ends of the legs, which forces result in a moment exerted on the ends of the contact pin whereby these ends are pivoted out of the original straight position. Thereby, the position of the ends of the contact pin with respect to the hole in which the contact pin is inserted, is not determined accurately anymore. When a wire wrap connection should be made with the end of the contact pin, the tool for making this connection cannot be brought in register with the corresponding end of the contact pin in the right manner anymore and this end could be bent. The same problem occurs when a connector should be mounted on the ends of an array of such contact pins.

Further the pivoting movement of the ends of the pin results in a collapsing of the legs as seen in cross section, so that the contact surface between the legs and the hole is only minimal and, moreover, this contact surface is only located at the insertion side of the hole where the stresses in the printed circuit board are at a maximum.

As the legs of the contact pin move mainly in the longitudinal direction through the hole, material scraped off of the lining of the wall and of the mounting portion of the contact pin, is pushed out of the hole. This material could cause a short-circuiting.

European patent application 0 105 044 relates to a contact pin of the above-mentioned kind wherein it is attempted to obviate said disadvantages by making the outer legs so that besides the movement parallel with the symmetry plane of the contact pin a torsion of the outer legs occurs. However, experiments have shown that the disadvantages mentioned are not overcome in a satisfactory way by this contact pin.

U.S. Pat. No. 4,230,384 discloses a contact pin with a mounting portion consisting of two torsion legs joining a solid contact pin portion at both ends. This known contact pin has the disadvantage that if at insertion into a relatively small hole the facing sides of the legs will contact each other no further deformation of the mounting portion for adaptation to the diameter of the small hole is possible. At small holes this could easily result in a damage of the lining of the wall of the hole.

Moreover, at this known contact pin the position of the pin in the hole depends on the diameter of the respective hole. As the dimensions of the solid contact pin portions are generally standardised, the dimensions of both legs of the mounting portion of this contact pin are fixed. In practice the rigidity of the legs appears to be substantially higher than is required for providing a sufficient retaining force of the contact pin in the hole. Thereby unnecessary high stresses are caused in the printed circuit board.

SUMMARY OF THE INVENTION

An object of the invention is to provide a contact pin of the above-mentioned kind wherein said disadvantages are obviated in a simple but nevertheless effective manner.

According to the present invention said first and second outer legs are mainly twisted to a position in which seen in cross section these outer legs extend obliquely outwardly from the centre leg, the centre leg being displaced radially outwardly with respect to the longitudinal axis of contact pin a constant distance substantially along its whole length and wherein seen in cross section the centre of a circle touching the outer side of each of said legs, lies at a distance from the longitudinal axis of the contact pin in a direction radially opposite from the centre leg.

In this manner a contact pin is obtained wherein at insertion into a hole of a printed circuit board the deformation of the mounting portion for adaptation to the diameter of the hole consists mainly of a torsion movement of both outer legs and wherein substantially no movement of one of the legs in a direction parallel with the symmetry plane of the contact pin occurs. Thereby no forces extending in the longitudinal direction of the contact pin will be exerted on the solid contact pin portions so that the ends of the contact pin will not be pivoted out of the original position. Moreover the centre leg substantially immediately provides for a positioning of the contact pin in the hole at insertion, which positioning is independent of the diameter of the hole. Further a relatively great variation of the diameter of the hole is allowable because at a relatively small diameter of the hole both outer legs may be twisted around the centre leg, while the centre leg may be pressed back between the outer legs.

According to a favourable embodiment the contact point of each outer leg with the circle touching the outer side of the three legs, lies on a radius from the centre of said circle enclosing an angle with the centre transverse plane of the contact pin which is less than 45°. Thereby the component directed perpendicular to the centre transverse plane of the force exerted on each of the outer legs at insertion of the contact pin into a hole, is so small that a movement of the outer legs parallel with the symmetry plane of the contact pin can hardly occur.

Preferably the length along which the outer legs are deformed by torsion from the solid contact pin portions, is at least three time greater than the length along which the centre leg is bent radially outwardly from the solid contact pin portions. In this manner it is obtained that at insertion of the contact pin the forces exerted on the wall of the hole increase uniformely so that a damage to the wall of the hole and the surrounding area of the printed circuit board is substantially precluded.

BRIEF DESCRIPTION OF THE DRAWINGS

The invention will hereinafter be further explained by reference to the drawings in which an embodiment of the contact pin of the invention is shown.

DESCRIPTION OF THE PREFERRED EMBODIMENT

Figure 1:
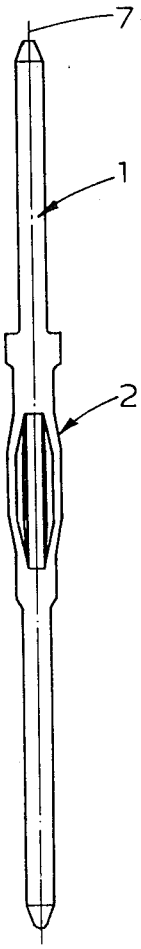
FIG. 1 shows a view of an embodiment of the contact pin according to the invention.

The contact pin 1 shown in FIG. 1 comprises a mounting portion 2 for mounting the contact pin in a hole of a printed circuit board not shown in the drawings. The wall of such a hole is normally provided with a lining of copper or the like which is electrically connected with one or more conductive circuit parts of the printed circuit board.

The mounting portion 2 should be designed in such a manner that at each hole diameter within the tolerance range of hole diameters on the one side a sufficient retaining force is generated and on the other side the lining of the hole and the surrounding arrea of the printed circuit board are not damaged in an unallowable manner.

Figure 3:
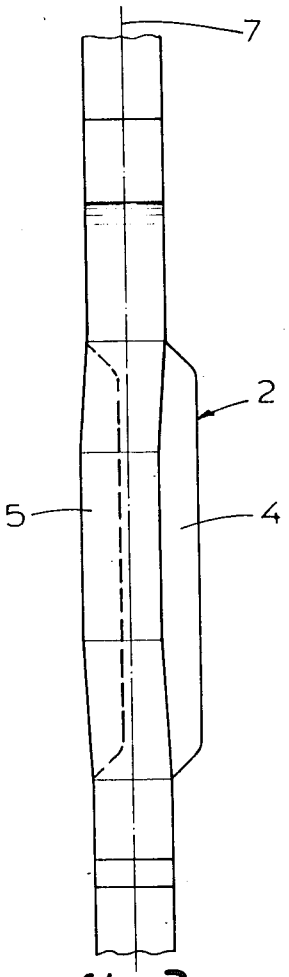
FIG. 3 is a side view of the mounting portion of the pin of FIG. 1 on a larger scale.
Figure 2:
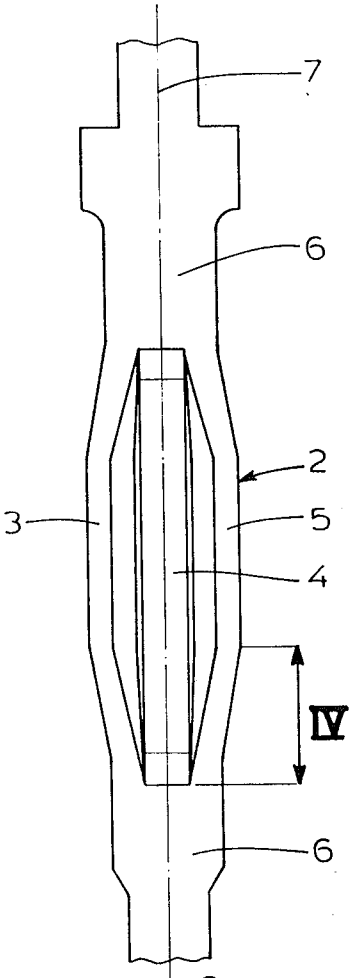
FIG. 2 is a front view of the mounting portion of thet contact pin of FIG. 1 on a larger scale.

The mounting portion 2 of the contact pin shown in FIGS. 2 and 3 in more detail, comprises three legs 3, 4 and 5 extending in the longitudinal direction of the contact pin and joining a solid contact pin portion 6 at both ends. It is also possible to separate the centre leg 4 at one end from the respective solid contact pin portion 6. The solid contact pin portions have a mainly rectangular cross section wherein the corners are rounded. The mounting portion 2 is normally coated with a soldering material.

The legs 3, 4 and 5 are cut out of the original solid part of the contact pin 1 such that each leg is also mainly rectangular, wherein the width of the centre leg 4 is substantially greater than the width of the outer legs 3 and 4. The width of the outer legs 3 and 5 can be chosen optimally with respect to the retaining force which is mainly determined by these legs 3 and 5. Thereby the stresses in the printed circuit board developed at insertion of the contact pin may be restricted.

It is noted that the ends of the contact pin can be made in different manners depending on the application of the pin. For example, one or both ends can be designed for making a wire wrap connection or can be made as a socket.

Referring especially to FIGS. 3 and 4A–4E, both outer legs 3, 5 are mainly twisted to a position in which these outer legs extend obliquely outwardly from the centre leg 4 as seen in cross section. The centre leg 4 itself is radially outwardly displaced along substantially its whole length a constant distance with respect to the longitudinal axis 7 of the contact pin 1, so that the bent portion of the centre leg 4 is only a fraction of its total length. FIGS. 4A–4E further show that the centre 8 of the circle touching the outer side of the legs 3, 4 and 5, lies at a distance from the longitudinal axis 7 of the contact pin 1 in a direction radially opposite from the centre leg.

Figure 4:
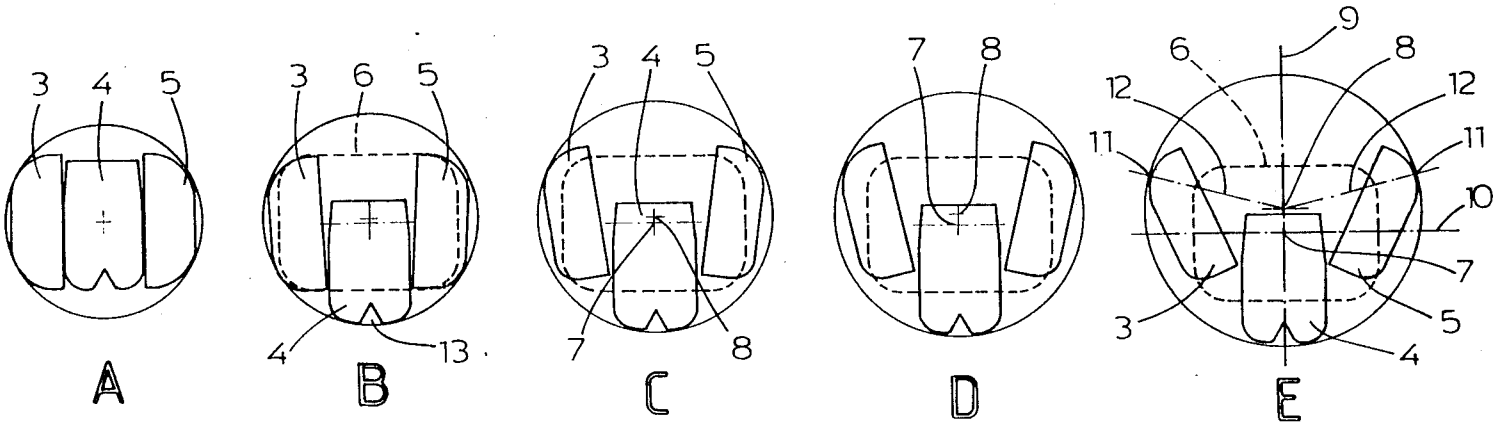
FIGS. 4A–4E show a plurality of cross sections of the mounting portion of FIG. 2 lying at different heights of the part indicated IV.

By the described construction of the mounting portion 2 of the contact pin 1 it is obtained that at insertion into a hole of a printed circuit board the deformation of the mounting portion 2 consists mainly of an inward rotation of the outer legs 3 and 5 without substantially any movement of the legs 3 and 5 parallel with the symmetry plane 9 of the contact pin 1 indicated in FIG. 4E. The centre leg 4 will be elastically bent only in a small measure without any collapsing of the legs. Within the full tolerance range of hole diameters this centre leg 4 almost immediately provides for a correct positioning of the contact pin 1 in the hole. Due to the small movement of the legs 3, 4 and 5 in the direction parallel with the symmetry plane 9 of the contact pin 1 it is prevented that a force extending in the longitudinal direction of the contact pin 1 is exerted on the solid contact pin portions 6, which force would otherwise cause a pivoting movement of the ends of the contact pin 1.

The centre leg 4 has such a rounding that after insertion into a hole this centre leg has always two contact surfaces with the wall of the hole, so that all together at least four contact surfaces exist between the mounting portion 2 and the wall of the hole. This results in a steady and reliable electrical connection.

The rounding of the surfaces of the legs 3, 4 and 5 contacting the wall of the hole, is such that a cold weld is realised between the contact pin and the lining of the wall, which results in very favourable electrical and mechanical properties of the connection between the contact pin and the lining of the wall.

Figure 5:
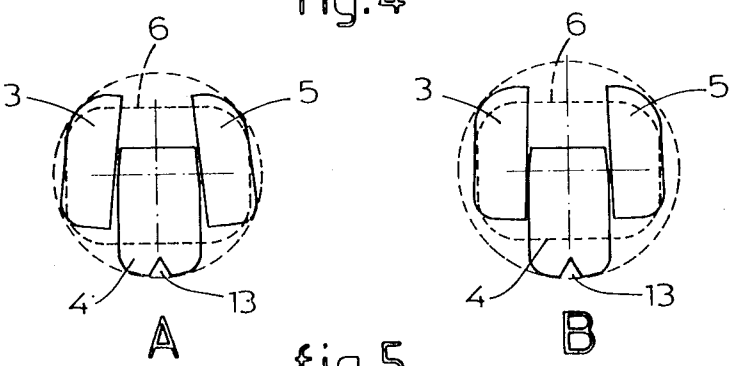
FIGS. 5A and 5B show two possible end positions the legs of the mounting portion of FIG. 2 after insertion of the contact pin into a hole of a printed circuit board.

Two possible end positions for the legs 3, 4 and 5 of the mounting portion 2 at a fully inserted contact pin 1, are shown in FIGS. 5A and 5B. FIGS. 5A and 5B clearly show that the deformation of the mounting portion 2 mainly consists of a torsion of the outer legs 3 and 5, whereas the legs 3, 4 and 5 are hardly displaced. Further it appears from FIGS. 5A and 5B, that the contact pin 1 can be mounted in holes with different diameters, wherein on the one side at a relatively large diameter a sufficient retaining force is exerted on the wall of the hole by the legs, whereas on the other side at a relatively small diameter the legs can still slightly yield, so that a damaging of the wall of the hole and the adjacent area of the printed circuit board is prevented.

This characteristic of the contact pin according to the invention is rather important as a damage of the wall of the hole and the adjacent area of the printed circuit board easily result in an interruption in the electrical circuits and thereby in a fault in the apparatus equiped with the contact pins.

From FIG. 5A it appears that at a small hole diameter the outer legs 3 and 5 are pressed against the wall of the hole at two locations so that in such cases six contact surfaces are obtained.

Preferably the legs 3–5 of the mounting portion 2 are formed in such a manner that the contact point of each outer leg 3, 5 with the circle touching the outer side of the legs 3–5, lies on a radius from the centre of said circle enclosing an angle with the centre transverse plane of the contact pin, which is smaller than 45°, preferably smaller than 35°. In FIG. 4E this centre transverse plane is indicated by 10 and said contact points are indicated by 11 and the corresponding radius by 12. The component directed perpendicular to the centre transverse plane 10 of the force exerted on the outer legs 3, 5 at insertion into a hole and directed along the radius 12, thereby has such a small value that a movement of the legs 3, 5 parallel with the symmetry plane 9 of the contact pin 1 can hardly occur.

As appears at a comparison of FIGS. 2 and 3, the length along which the outer legs 3 and 5 are deformed by torsion from the solid contact pin portions 6, is at least three times greater than the length along which the centre leg is bent radially outwardly from the solid contact pin portions 6.

At insertion of the contact pin 1 into a hole of a printed circuit board the forces exerted by the mounting portion 2 on the wall of the hole will thereby uniformely increase so that even at extreme circumstances no damage of the wall of the hole and the adjacent area of the printed circuit board will be caused.

FIGS. 4A–4E further show that the part of the centre leg 4 lying between the outer legs 3, 5 is bevelled at the sides facing the outer legs. Thereby the torsion movement of the outer legs 3, 5 towards the position shown in FIG. 5A, is facilitated.

In the outwardly directed side of the centre leg 4 a groove-like recess 13 provided acting as a receiving space for any scraped off material.

The invention is not restricted to the above-described embodiment which can be varied in a number of ways within the scope of the claims.

What is claimed is:

1. A contact pin for a printed circuit board comprising a mounting portion for mounting the contact pin in a hole in the printed circuit board, said mounting portion having a center leg and first and second outer legs, said center leg being displaced radially outwardly with respect to the longitudinal axis of said contact pin to provide a contact surface substantially along said center leg, at least said outer legs joining a solid pin portion at both ends, each of said outer legs being twisted outwardly from said inner leg when said contact pin is in an uninserted condition, said center leg being disposed between said outer legs in an uninserted position, said legs being disposed such that, in cross section, the center of a circle touching an outer side of said legs is distanced from the longitudinal axis of said contact pin in a direction radially opposite from said center leg, said legs being constructed and arranged to be twisted inwardly towards each other by engagement with said hole when said contact pin is inserted in said hole in said printed circuit board with said center leg remaining therebetween, said twisting of said outer legs serving to retain said contact pin in said hole.

2. A contact pin according to claim 1 wherein the contact point of each of said first and said second outer legs, with a circle touching the outer side of the three legs, lies on a radius from the center of said circle enclosing an angle of less than 45° with a plane disposed transverse to the major axis of said center leg when viewed in cross section.

3. A contact pin according to claim 1 wherein a portion of said center leg disposed between said outer legs is beveled at the sides facing said outer legs.

4. A contact pin according to claim 1 wherein the cross-section of said center leg is substantially greater than that of either of said outer legs.

5. A contact pin according to claim 1 wherein the edges of said legs which contact said hole are rounded.

* * * * *